US011511335B2

(12) United States Patent
Ariyama et al.

(10) Patent No.: US 11,511,335 B2
(45) Date of Patent: Nov. 29, 2022

(54) GAS SUCTION DEVICE OF CASTING MOLD

(71) Applicant: HONDA MOTOR CO., LTD., Tokyo (JP)

(72) Inventors: Yuki Ariyama, Tokyo (JP); Masahiro Yamada, Tokyo (JP); Satoru Kimura, Tokyo (JP); Kenji Yuki, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/681,950

(22) Filed: Feb. 28, 2022

(65) Prior Publication Data

US 2022/0314309 A1 Oct. 6, 2022

(30) Foreign Application Priority Data

Mar. 30, 2021 (JP) ..... JP2021-057199

(51) Int. Cl.
*B22D 18/06* (2006.01)
*B22C 9/06* (2006.01)

(52) U.S. Cl.
CPC ..... *B22D 18/06* (2013.01); *B22C 9/06* (2013.01)

(58) Field of Classification Search
CPC ..... B22D 18/00; B22D 18/06; B22D 27/15; B22D 17/14; B22D 17/20; B22D 17/145; B22C 9/06
See application file for complete search history.

(56) References Cited

U.S. PATENT DOCUMENTS 4,852,634 A * 8/1989 Kawai ..... B22D 17/145 164/113

FOREIGN PATENT DOCUMENTS

| | | |
|---|---|---|
| JP | 11-057968 | 3/1999 |
| JP | 3969137 | 9/2007 |
| JP | 6765401 | 10/2020 |

* cited by examiner

*Primary Examiner* — Kevin P Kerns
*Assistant Examiner* — Steven S Ha
(74) *Attorney, Agent, or Firm* — Amin, Turocy & Watson, LLP

(57) ABSTRACT

A gas suction device of a casting mold includes an overflow portion, a suction path, and a shut-off valve. The shut-off valve includes a housing section for housing a valve element. An upstream-side housing portion of the housing section has an arc-shaped outer peripheral edge. The overflow portion includes an introduction path which is continuous with the upstream-side housing portion and guides gas to the upstream-side housing portion. At a predetermined location on the outer peripheral edge, the introduction path is connected to the upstream-side housing portion along the tangential direction of the outer peripheral edge.

7 Claims, 5 Drawing Sheets

GAS SUCTION DEVICE OF CASTING MOLD

CROSS-REFERENCE TO RELATED APPLICATIONS

This application is based upon and claims the benefit of priority from Japanese Patent Application No. 2021-057199 filed on Mar. 30, 2021, the contents of which are incorporated herein by reference.

BACKGROUND OF THE INVENTION

Field of the Invention

The present invention relates to a gas suction device of a casting mold for sucking gas from a cavity portion of the casting mold.

Description of the Related Art

Vacuum casting systems are known (for example, JP 3969137 B2). In the vacuum casting system, after the gas in the cavity of a casting mold is sucked by a gas suction device, molten metal is injected into the cavity to perform casting. The gas suction device can remove gas (air) in the cavity of the casting mold, thereby reducing gas defects in a cast product caused by the gas mixed into the molten metal.

However, foreign matter (for example, the mold release agent or molten metal powder) sucked into the system together with the gas may interfere with the operation of the system. For example, in the casting system disclosed in JP 3969137 B2, foreign matter may adhere to the shut-off valve on the suction path. Adhesion of foreign matter to the shut-off valve reduces the sealing performance of the shut-off valve. Foreign matter adhering to the shut-off valve can be removed by maintenance operations. However, frequent maintenance reduces the effective operating rate of the casting mold.

SUMMARY OF THE INVENTION

As described above, for a gas suction device of a casting mold, it is a task to suppress adhesion of foreign matter to the shut-off valve on the suction path and to efficiently suck gas. An object of the present invention is to achieve this task.

According to an aspect of the present invention, provided is a gas suction device of a casting mold, comprising: an overflow portion connected to a cavity portion of a casting mold and formed along a predetermined surface; a suction path configured to suck gas in the cavity portion via the overflow portion; and a shut-off valve connected between the overflow portion and the suction path and configured to allow the suction path to be blocked, wherein the shut-off valve includes a valve element and a housing section configured to house the valve element, the housing section includes a valve seat portion, an upstream-side housing portion located on an upstream side of the valve seat portion, and a downstream-side housing portion located on a downstream side of the valve seat portion, the valve element includes an abutment portion configured to abut against the valve seat portion to block the suction path, an upstream-side valve portion located on the upstream side of the abutment portion, and a downstream-side valve portion located on the downstream side of the abutment portion, the predetermined surface includes an angle reference surface between the overflow portion and a position where an axis of the valve element intersects the predetermined surface, an angle formed by an axis of the downstream-side housing portion and the angle reference surface is an obtuse angle, the upstream-side housing portion includes an outer peripheral edge having an arc shape on the predetermined surface, the overflow portion includes an introduction path continuous with the upstream-side housing portion and configured to guide the gas to the upstream-side housing portion, and at a predetermined location on the outer peripheral edge, the introduction path is connected to the upstream-side housing portion along a tangential direction of the outer peripheral edge.

According to the present invention, it is possible to provide a gas suction device of a casting mold, which can suppress adhesion of foreign matter to the shut-off valve on the suction path and can efficiently suck gas.

BRIEF DESCRIPTION OF THE DRAWINGS

The above and other objects, features, and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

Figure 1:
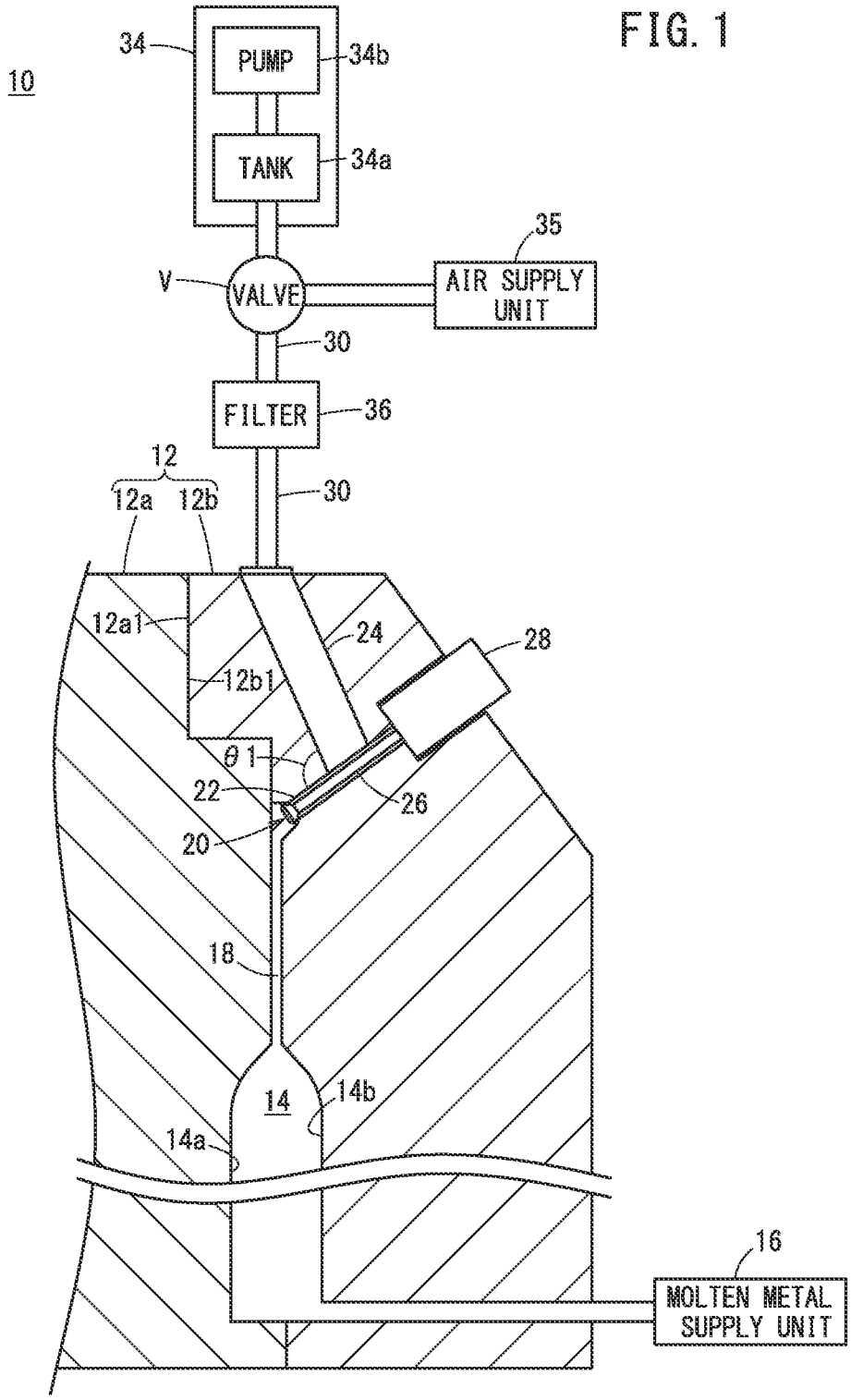
Figure 2:
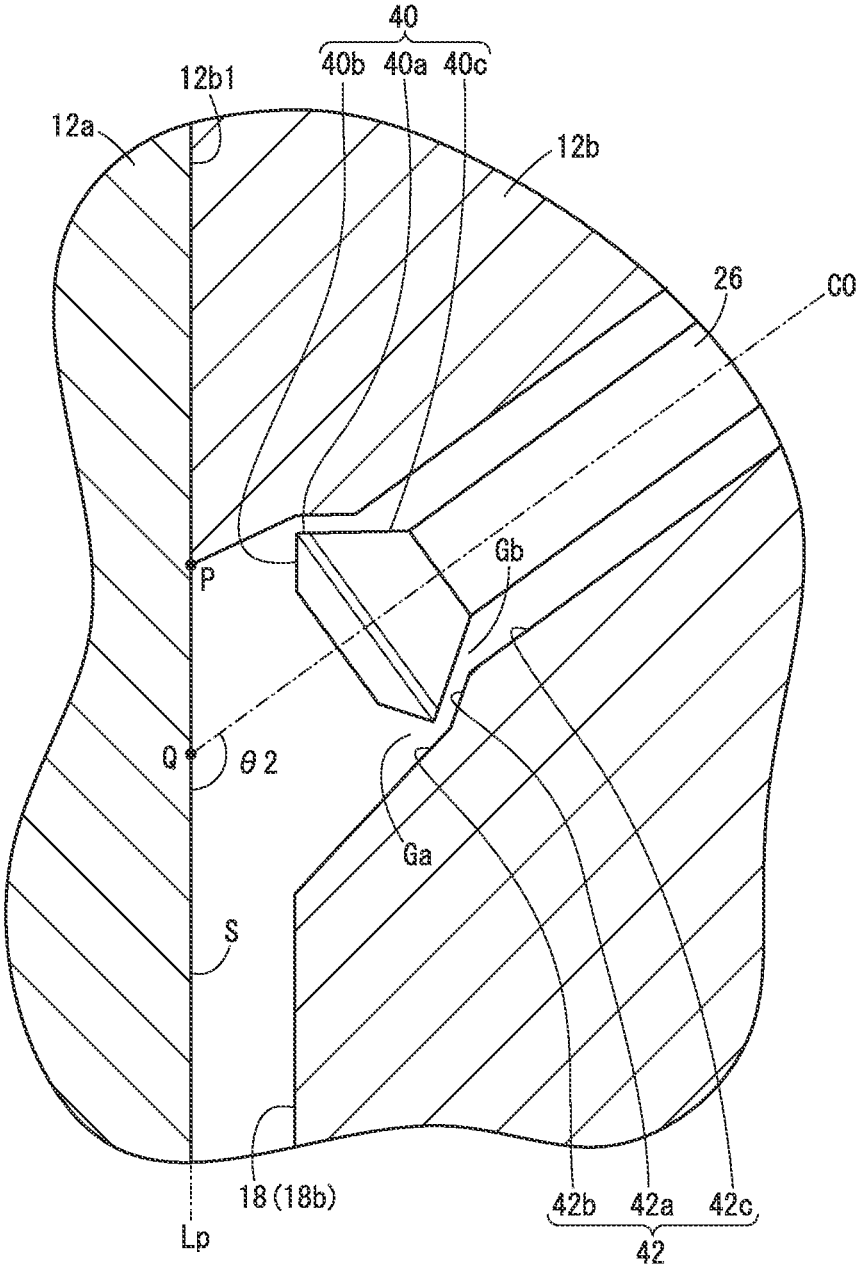
Figure 3:
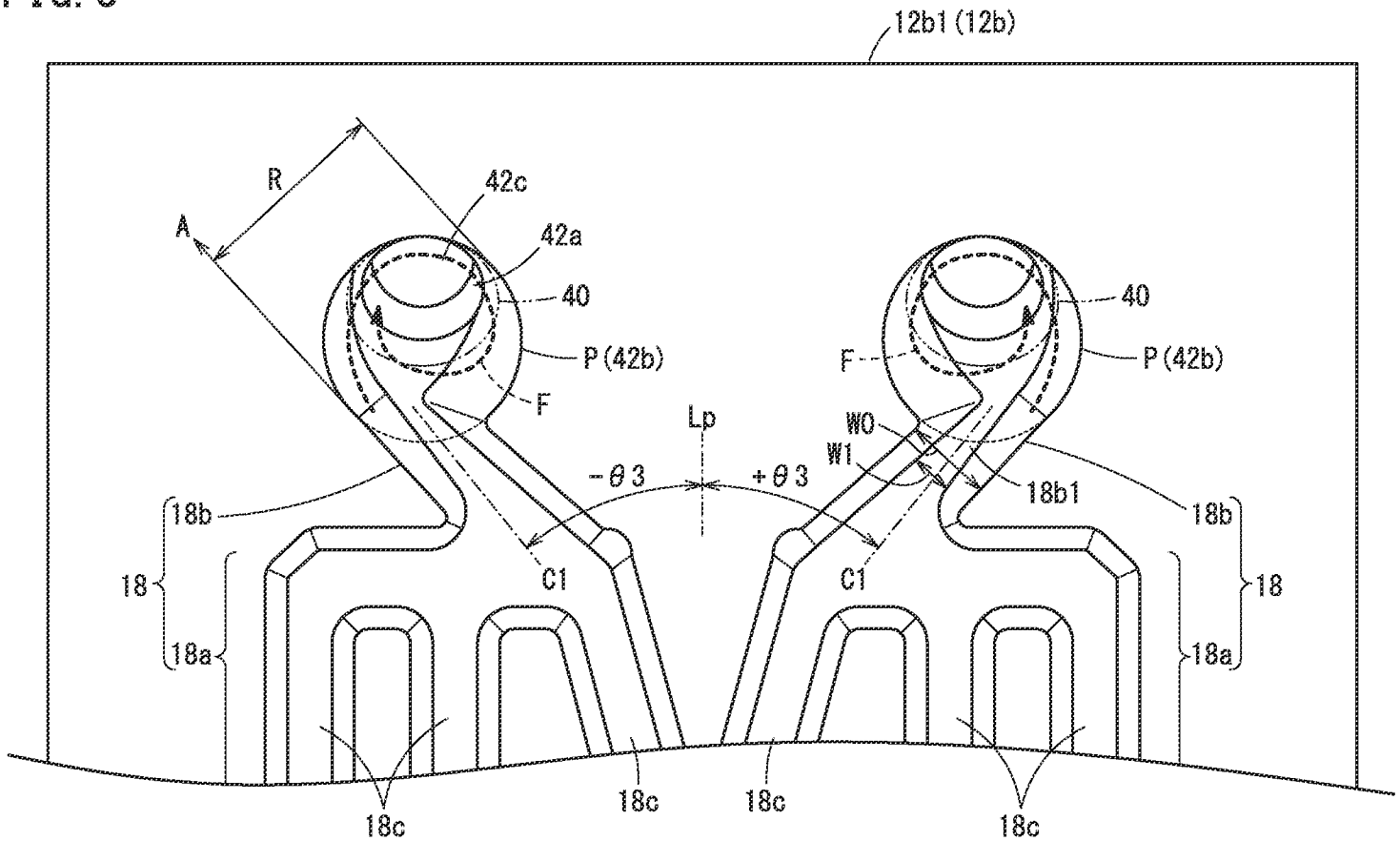
Figure 4:
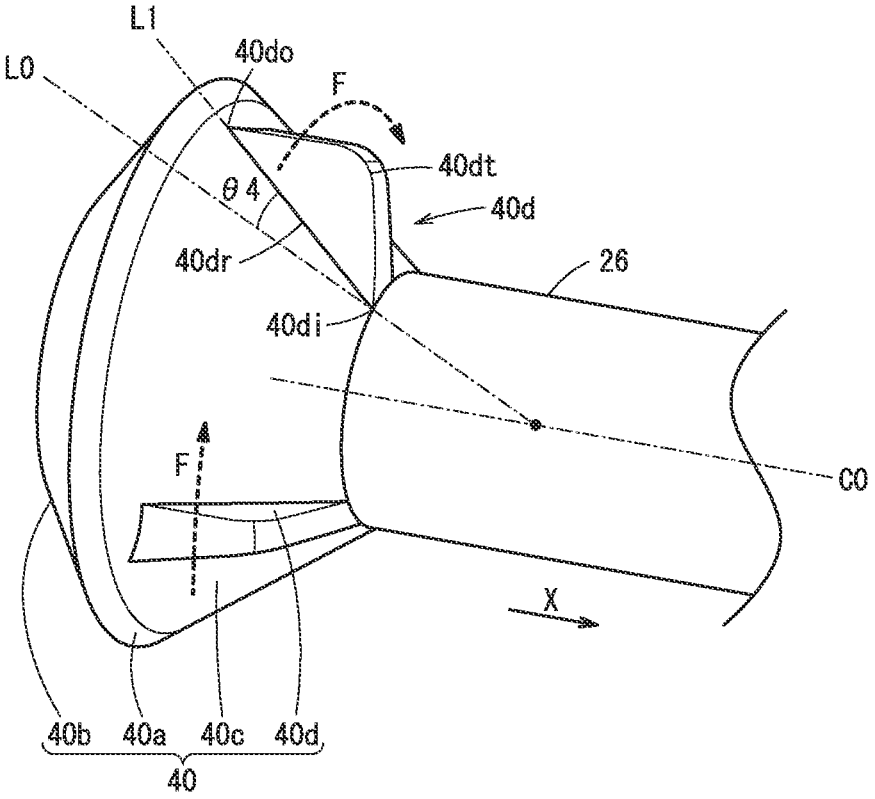
Figure 5:
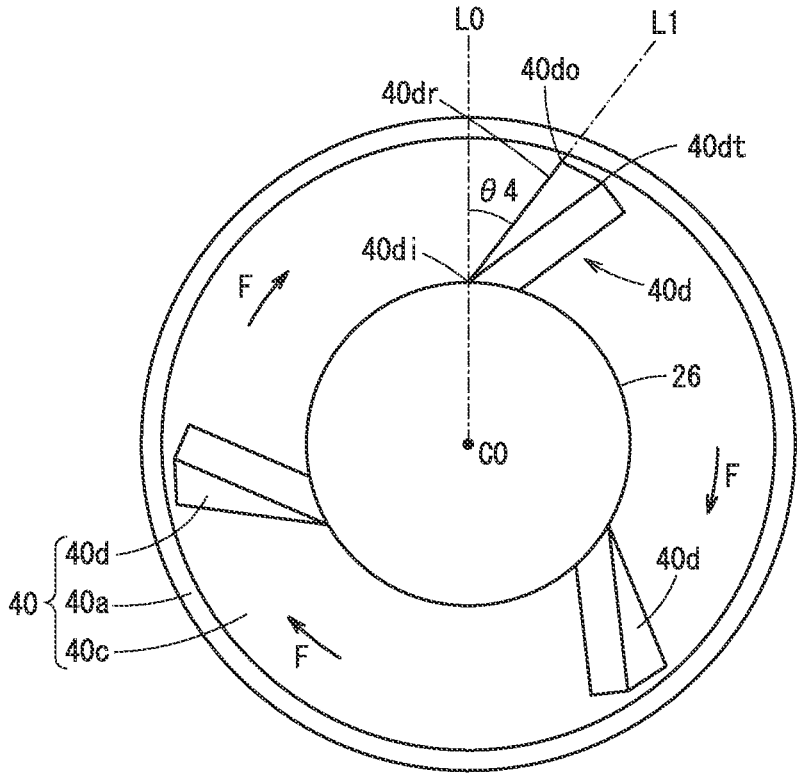

FIG. 1 shows a gas suction device of a casting mold according to an embodiment of the present invention;

FIG. 2 is an enlarged view of a shut-off valve and its vicinity;

FIG. 3 shows a state in which the shut-off valve is viewed from a movable mold side;

FIG. 4 is an enlarged view of the valve element of the shut-off valve according to a modification; and FIG. 5 shows a state in which the valve element of FIG. 4 is viewed from the downstream side in a direction along the axis of the valve element.

DESCRIPTION OF THE INVENTION

Hereinafter, a gas suction device of a casting mold according to an embodiment of the present invention will be described. FIG. 1 shows a gas suction device 10 of a casting mold 12 according to the embodiment of the present invention.

The casting mold 12 is provided with the gas suction device 10. The casting mold 12 includes a movable mold 12*a* and a fixed mold 12*b*. The movable mold 12*a* is disposed on the left side of the fixed mold 12*b* in the drawing, and can move toward and away from the fixed mold 12*b* in the lateral direction (horizontal direction) in the drawing. The movable mold 12*a* and the fixed mold 12*b* respectively have a mating surface 12*a*1 and a mating surface 12*b*1 that face each other. The mating surface 12*a*1 and the mating surface 12*b*1 have a concave portion 14*a* and a concave portion 14*b*, respectively. The concave portion 14*a* and the concave portion 14*b* form a cavity portion 14. The movable mold 12*a* is moved toward the fixed mold 12*b*, and the mating surface 12*a*1 and the mating surface 12*b*1 are brought into contact with each other, whereby the casting mold 12 is closed. As the casting mold 12 is closed, the cavity portion 14 is formed in the casting mold 12.

The casting mold 12 includes a molten metal supply unit 16. The molten metal supply unit 16 is connected to the fixed mold 12*b*. The molten metal supply unit 16 supplies molten metal into the cavity portion 14. The fixed mold 12*b* includes an overflow portion 18 downstream of the cavity portion 14. The overflow portion 18 is connected to the cavity portion 14. The overflow portion 18 extends along the mating surface 12*b*1 (predetermined surface) of the fixed mold 12*b*. The molten metal supplied to the cavity portion 14 reaches the overflow portion 18 and then solidifies inside the cavity portion 14 and the overflow portion 18. The solidified molten metal is taken out from the casting mold 12 as a cast product.

The casting mold 12 includes a shut-off valve 20, a suction path 22, and a suction path 24. The shut-off valve 20 is disposed between the overflow portion 18 and the suction path 22, and can block the suction path 22. The shut-off valve 20 is opened and closed by a valve drive unit 28 having a drive shaft 26, thereby preventing the molten metal from entering the suction path 22 from the overflow portion 18.

Typically, a plurality of sets of the overflow portion 18, the shut-off valve 20, and the suction path 22 are connected between the cavity portion 14 and the suction path 24. That is, a plurality of the overflow portions 18 are connected to the cavity portion 14. Further, a plurality of the suction paths 22 are connected to the suction path 24.

The suction path 24 is connected to a gas suction unit 34 through a suction path 30 and a valve V that are disposed outside the casting mold 12. The gas suction unit 34 sucks gas in the cavity portion 14 through the valve V, the suction path 30, the suction path 24, the suction path 22, and the overflow portion 18. A filter 36 is attached to the suction path 30. The filter 36 traps foreign matter in the gas in the suction path 30. The gas suction unit 34 includes a tank 34*a* and a pump 34*b*. The gas suction unit 34 sucks gas in the cavity portion 14 by the tank 34*a* depressurized by the pump 34*b*. Before supplying the molten metal to the cavity portion 14, the gas suction unit 34 sucks and removes the gas in the cavity portion 14. Thus, gas defects (for example, blow holes) caused by the mixing of gas into the molten metal can be reduced. In addition, trapping foreign matter in the gas by the filter 36 can suppress the reduction of the sealing performance of the shut-off valve 20 caused by adhesion of foreign matter between a valve element 40 and a valve seat portion 42*a* of the shut-off valve 20.

Here, the suction path 22 and the suction path 24 are connected at an obtuse angle θ1 in the casting mold 12. The angle θ1 is set to enable the suction path 22 to suck the gas in a spiral shape to suppress disturbance of the gas flow in the vicinity of the valve element 40. As a result, the gas can be easily sucked without the foreign matter being retained.

The gas suction unit 34 and an air supply unit 35 are connected to the valve V. The valve V switches between the connection between the suction path 30 and the gas suction unit 34, and the connection between the suction path 30 and the air supply unit 35. By feeding air into the suction path 30 by the air supply unit 35 when the casting mold 12 is opened, the suction path 24, the suction path 22, the shut-off valve 20, and the overflow portion 18 can be air-blown. As a result, the suction path 24, the suction path 22, and the shut-off valve 20 can be cleaned. For example, this air blowing can be performed at the time of opening of the casting mold 12 after the release of a cast product. Instead of using the air supply unit 35, the gas suction unit 34 may supply air to the suction path 30 through the tank 34*a* from the pump 34*b* whose operation is reversed.

FIG. 2 is an enlarged view of the shut-off valve 20 and its vicinity. The shut-off valve 20 includes the valve element 40 and a housing section 42 for housing the valve element 40. Here, the valve element 40 does not include a rib 40*d* (FIGS. 4 and 5) to be described later. The housing section 42 includes the valve seat portion 42*a*, an upstream-side housing portion 42*b*, and a downstream-side housing portion 42*c*. The upstream-side housing portion 42*b* is disposed upstream of the valve seat portion 42*a*. The downstream-side housing portion 42*c* is disposed downstream of the valve seat portion 42*a*. The valve element 40 includes an abutment portion 40*a*, an upstream-side valve portion 40*b*, and a downstream-side valve portion 40*c*. The abutment portion 40*a* abuts against the valve seat portion 42*a*, thereby blocking the suction path 22. The upstream-side valve portion 40*b* is disposed upstream of the abutment portion 40*a*. The downstream-side valve portion 40*c* is disposed downstream of the abutment portion 40*a*.

The suction path 22, the valve element 40 (the abutment portion 40*a*, the upstream-side valve portion 40*b*, and the downstream-side valve portion 40*c*), and the housing section 42 (the valve seat portion 42*a*, the upstream-side housing portion 42*b*, and the downstream-side housing portion 42*c*) have a common axis C0. The axis C0 forms an obtuse angle θ2 with respect to an angle reference surface S. The angle reference surface S is set on the mating surface 12*b*1 having the overflow portion 18, in order to serve as a reference of the angle θ2. The angle reference surface S is substantially flush with the mating surface 12*b*1 (predetermined surface). Here, the angle reference surface S is set between a position Q and the overflow portion 18. The position Q is a position where the axis C0 of the valve element 40 and the mating surface 12*b*1 intersect. The overflow portion 18 is disposed on the mating surface 12*b*1 (vertical surface) along a vertical line Lp, and basically extends along the vertical line Lp. That is, the angle θ2 is substantially an angle formed by the suction path 22 and the overflow portion 18. Setting the angle θ2 to an obtuse angle suppresses the occurrence of turbulent flow due to a rapid change in the direction in which gas flows. As a result, adhesion and sticking of foreign matter to the valve element 40, the housing section 42, and the suction path 22 are suppressed.

On the other hand, setting the angle θ2 to an acute angle facilitates the occurrence of turbulent flow of gas in the vicinity of the shut-off valve 20. This turbulent flow may cause the foreign matter to collide with the surface of the shut-off valve 20 or the suction path 22, thereby causing the foreign matter to adhere or stick to this surface. The adhered or stuck foreign matter may reduce the sealing performance of the shut-off valve 20. The adhered or stuck foreign matter may clog the shut-off valve 20 or the suction path 22. The reduction in sealing performance means that leakage from the closed shut-off valve 20 occurs.

FIG. 3 shows a state in which the shut-off valve 20 is viewed from the movable mold 12*a* toward the fixed mold 12*b*. For the sake of easy understanding, the valve element 40 is indicated by an imaginary line. As shown in FIG. 3, the two overflow portions 18 are arranged in a substantially bilaterally symmetrical manner. Each of the two overflow portions 18 is disposed on the mating surface 12*b*1 (predetermined surface) and includes an overflow portion main body 18*a* and an introduction path 18*b*. The overflow portion main body 18*a* includes a plurality of flow paths 18*c*. The plurality of flow paths 18*c* are connected to the cavity portion 14 and are connected to each other at the upper portions thereof. The introduction path 18*b* is connected to the upper portion of the overflow portion main body 18*a* and is continuous to the upstream-side housing portion 42*b*. The introduction path 18*b* guides gas from the overflow portion main body 18*a* to the upstream-side housing portion 42*b*.

The overflow portion 18, particularly the introduction path 18*b*, of the present embodiment has a relatively short linear shape. Unlike the present embodiment, when the introduction path 18*b* is made to meander in a complicated manner and to be longer, the molten metal is cooled in the introduction path 18*b*. Thus, the velocity of the molten metal is reduced, and as a result, it is possible to prevent the molten metal from blowing out from the introduction path 18*b*. Further, foreign matter can be trapped in the introduction path 18*b*. However, making the introduction path 18*b* meander and longer increases the capacity of the overflow portion 18, resulting in an increase in the amount of molten metal that is not used for producing the product itself. In the present embodiment, since the introduction path 18*b* has a relatively short linear shape, the waste of molten metal is reduced. On the other hand, since the amount of foreign matter trapped in the introduction path 18*b* is reduced, the amount of foreign matter adhering to the shut-off valve 20 increases. In the present embodiment, as will be described later, by devising the shape of the vicinity of the shut-off valve 20, the gas is swirled in the vicinity of the shut-off valve 20. Swirling of the gas suppresses the stagnation of the gas in the vicinity of the shut-off valve, and as a result, prevents the foreign matter from being caught in the shut-off valve 20 (eventually, adhering or sticking to the shut-off valve 20).

The upstream-side housing portion 42*b* has an arcuate outer peripheral edge P on the mating surface 12*b*1 (predetermined surface). At a predetermined location on the outer peripheral edge P, the introduction path 18*b* is connected to the upstream-side housing portion 42*b* along a tangential direction A of the outer peripheral edge P. As a result, the gas flowing from the introduction path 18*b* into the upstream-side housing portion 42*b* forms a swirling flow F. The swirling flow F is a flow of gas swirling along the outer peripheral edge P. While swirling around the axis C0 of the valve element 40 within the housing section 42, the swirling flow F moves downstream of the housing section 42. The gas swirling along the outer peripheral edge P flows along the surfaces of the upstream-side housing portion 42*b* and the upstream-side valve portion 40*b*. The swirling of the gas prevents foreign matter in the gas from adhering or sticking to the vicinity of the shut-off valve 20. The foreign matter that has adhered or stuck to the vicinity of the shut-off valve 20 is eventually caught in the seal portion of the shut-off valve 20. The vicinity of the shut-off valve 20 means, for example, the upstream-side housing portion 42*b* and the upstream-side valve portion 40*b*.

A central axis C1 of the introduction path 18*b* extends along the mating surface 12*b*1 (vertical surface) and forms a predetermined angle θ3 with respect to the vertical line Lp. The introduction path 18*b* on the left side of FIG. 3 forms a negative angle −θ3 with respect to the vertical line Lp. The introduction path 18*b* on the right side forms a positive angle +θ3 with respect to the vertical line Lp. Here, since the two introduction paths 18*b* are substantially bilaterally symmetrical, the angles ±θ3 formed by the two introduction paths 18*b* with respect to the vertical line Lp have the same absolute value and different positive and negative signs. The absolute value of the angles ±θ3 may be different depending on the introduction paths 18*b*.

The absolute value and the positive and negative signs of the angles ±θ3 relate to the swirling force and the swirling direction of the swirling flow F. When the absolute value of the angles ±θ3 is larger than 0, the gas swirls easily. The positive and negative signs of the angles ±θ3 relate to the swirling direction. The gas from the introduction path 18*b* on the left side of FIG. 3 swirls clockwise along the outer peripheral edge P. The gas from the introduction path 18*b* on the right side in FIG. 3 swirls counterclockwise along the outer peripheral edge P. When the absolute value of the angles ±θ3 is, for example, 30 to 60, the generation of vortices in the vicinity of the valve element 40 is suppressed. When a vortex is generated in the vicinity of the valve element 40, foreign matter in the gas is entrained in the vortex, and as a result, the foreign matter may adhere to the valve element 40.

Here, a width W0 of the introduction path 18*b* is smaller than a diameter R of the outer peripheral edge P (W0<R). Further, the introduction path 18*b* is connected to the outer peripheral edge P in such a manner that the center axis C1 of the introduction path 18*b* is shifted from the center of the outer peripheral edge P. As a result, the velocity of the gas flowing from the introduction path 18*b* into the upstream-side housing portion 42*b* increases, and consequently, the swirling force of the gas increases. The swirling force more strongly prevents foreign matter in the gas from adhering or sticking to the shut-off valve 20.

The introduction path 18*b* has a planar bottom surface 18*b*1 extending along the central axis C1 of the introduction path 18*b*. The mating surface 12*b*1 has a connecting portion on which the introduction path 18*b* and the outer peripheral edge P are connected to each other. A width W1 of the bottom surface 18*b*1 becomes smaller toward this connection portion. It is noted that, as the width W1 of the introduction path 18*b* becomes smaller, the depth of the bottom surface 18*b*1 becomes greater. That is, the cross-sectional area (eventually, the conductance) of the introduction path 18*b* is substantially constant. Thus, a rapid flow of the gas can be maintained.

Here, in accordance with the swirling of the gas, the foreign matter in the gas swirls, whereby a centrifugal force is applied to the foreign matter in the gas. As a result, there is a possibility that a relatively heavy foreign matter (for example, a powder burr or a solid release agent) in the foreign matter in the gas is separated from the flow of the gas and falls into the upstream-side housing portion 42*b*. In many cases, the fallen foreign matter does not adhere or stick to the surface of the upstream-side housing portion 42*b*. Therefore, most of the foreign matter falling on the upstream-side housing portion 42*b* can be removed relatively easily. For example, by opening the casting mold 12 and air-blowing the casting mold 12 from the gas suction unit 34, the foreign matter on the upstream-side housing portion 42*b* can be discharged out of the casting mold 12. The upstream-side housing portion 42*b* is opened downward (downward along the vertical line Lp). Therefore, the foreign matter on the surface of the upstream-side housing portion 42*b* can be relatively easily removed and discharged by air blowing.

Referring back to FIG. 2, the movement of the gas after having flowed from the introduction path 18*b* into the upstream-side housing portion 42*b* will be described. On a plane perpendicular to the axis C0 of the upstream-side housing portion 42*b*, a gap Ga is defined between the upstream-side housing portion 42*b* and the upstream-side valve portion 40*b*. At least when the shut-off valve 20 is in the open state, the cross-sectional area of the gap Ga becomes smaller toward the abutment portion 40*a*. As a result, the velocity of the gas flowing from the introduction path 18*b* into the upstream-side housing portion 42*b* increases toward the abutment portion 40*a*. As a result, the foreign matter in the gas is less likely to adhere to the valve element 40 and the housing section 42 (here, the upstream-side valve portion 40*b* and the upstream-side housing portion 42*b*). Here, the upstream-side valve portion 40*b* has a truncated cone shape whose diameter increases toward the abutment portion 40*a*. Thus, the cross-sectional area of the gap Ga becomes smaller toward the abutment portion 40*a*.

Further, on a plane perpendicular to the axis C0 of the downstream-side housing portion 42*c*, a gap Gb is defined between the downstream-side housing portion 42*c* and the downstream-side valve portion 40*c*. At least when the shut-off valve 20 is in the open state, the cross-sectional area of the gap Gb becomes larger toward the drive shaft 26 within a certain distance from the abutment portion 40*a*. Thus, occurrence of turbulent flow in the downstream-side housing portion 42*c* is suppressed. As a result, the swirling flow F of the gas is maintained, and stagnation of the gas in the valve element 40 and the housing section 42 (in this case, the downstream-side valve portion 40*c* and the downstream-side housing portion 42*c*) is suppressed. Therefore, separation and adhesion of the foreign matter due to a decrease in the flow rate of the gas are suppressed, and as a result, the foreign matter is prevented from being caught in the shut-off valve 20. Here, the downstream-side valve portion 40*c* has a truncated cone shape whose diameter decreases toward the drive shaft 26. Thus, the cross-sectional area of the gap Gb becomes larger toward the downstream side of the abutment portion 40*a*.

In this manner, the gas flowing from the introduction path 18*b* into the upstream-side housing portion 42*b* forms the swirling flow F. The swirling flow F swirls along the outer peripheral edge P of the upstream-side housing portion 42*b*. The swirling flow F flows into the downstream-side housing portion 42*c* from the upstream-side housing portion 42*b*. It is noted that, in the downstream-side housing portion 42*c* according to the present embodiment, the valve element 40 may not include the rib 40*d* as shown in FIG. 4, for example. However, in order to maintain and enhance the swirling flow F, it is preferable that the valve element 40 includes the rib 40*d*.

FIG. 4 is an enlarged view of an example of the valve element 40 of the shut-off valve 20 according to a modification. FIG. 5 shows a state in which the valve element 40 of FIG. 4 is viewed from the downstream side in a direction along the axis C0 of the valve element 40. The valve element 40 includes, on the downstream-side valve portion 40*c*, the rib 40*d* extending so as to follow the flow direction of the swirling flow F. The valve element 40 may not include the rib 40*d*. As described above, the present embodiment corresponds to a case where the rib 40*d* is not provided. As shown in FIGS. 4 and 5, the rib 40*d* extends along a line L1 (extension line). The line L1 forms an angle θ4 with respect to a reference line L0. The reference line L0 is set so as to extend from the axis C0 along the surface of the downstream-side valve portion 40*c*. That is, the rib 40*d* is inclined in the swirling direction of the swirling flow F toward the outside in the radial direction of the valve element 40 (inclined relative to the radial direction). Therefore, a radially outer end 40*do* of the rib 40*d* is located on the more downstream side of the swirling flow F in the circumferential direction of the valve element 40, than a radially inner end 40*di* of the rib 40*d*. In addition, the rib 40*d* is inclined in the swirling direction of the swirling flow F viewed from an arrow X direction in FIG. 4 (inclined relative to the axial direction). The arrow X direction is a direction along the axial direction of the valve element 40 on the drive shaft 26 side and toward the downstream side. Therefore, a root 40*dr* of the rib 40*d* is located more on the upstream side of the swirling flow F in the circumferential direction of the valve element 40, than a top 40*dt* of the rib 40*d* (the protruding end from the downstream-side valve portion 40*c*).

Here, when the valve element 40 is viewed in the downstream direction, the angle θ4 is set to be a negative angle (angle of clockwise rotation). As a result, the clockwise swirling flow F is maintained when the valve element 40 is viewed in the downstream direction. That is, the positive and negative signs of the angle θ3 formed by the introduction path 18*b* and the upstream-side housing portion 42*b* correspond to the positive and negative signs of the angle θ4 formed by the extending direction of the rib 40*d* and the reference line L0. As a result, the swirling flow F generated in the upstream-side housing portion 42*b* is maintained. In addition, the inclination of the rib 40*d* in the swirling direction of the swirling flow F viewed from the axial direction (X direction) makes it easier to maintain the swirling flow F.

Here, three ribs 40*d* are arranged along the outer peripheral surface of the downstream-side valve portion 40*c*. However, the number of the ribs 40*d* may be an appropriate number of two or more. Thus, providing the ribs in the valve element 40 makes it easier to maintain the swirling flow F of the gas in the downstream-side housing portion 42*c*.

As described above, in the present embodiment, the gas swirls in the vicinity of the shut-off valve 20. Therefore, the foreign matter in the gas sucked from the cavity portion 14 basically passes through the suction path 22 without adhering or sticking to the shut-off valve 20. Eventually, the foreign matter in the gas is trapped by the filter 36. As a result, the gas suction device 10 can maintain a satisfactory state for a long period of time. As described above, the centrifugal force generated by the swirling of the gas may cause a relatively heavy foreign matter in the gas to fall into the upstream-side housing portion 42*b*. However, this foreign matter does not adhere or stick to the upstream-side housing portion 42*b*. Therefore, the foreign matter can be easily removed by air blowing from the gas suction unit 34. Note that the present invention is not limited to the embodiments described above, and various configurations can be adopted therein without departing from the gist of the present invention.

Invention Obtained from Embodiments

The invention that can be grasped from the above embodiments will be described below.

[1] A gas suction device (10) of a casting mold (12) comprises: an overflow portion (18) connected to a cavity portion (14) of the casting mold and formed along a predetermined surface (mating surface 12*b*1); a suction path (22) configured to suck gas in the cavity portion via the overflow portion; and a shut-off valve (20) connected between the overflow portion and the suction path and configured to allow the suction path to be blocked, wherein the shut-off valve includes a valve element (40) and a housing section (42) configured to house the valve element, the housing section includes a valve seat portion (42*a*), an upstream-side housing portion (42*b*) located on an upstream side of the valve seat portion, and a downstream-side housing portion (42*c*) located on a downstream side of the valve seat portion, the valve element includes an abutment portion (40*a*) configured to abut against the valve seat portion to block the suction path, an upstream-side valve portion (40*b*) located on the upstream side of the abutment portion, and a downstream-side valve portion (40*c*) located on the downstream side of the abutment portion, the predetermined surface includes an angle reference surface (S) between the overflow portion and a position where an axis (C0) of the valve element intersects the predetermined surface, an angle (θ2) formed by an axis (C0) of the downstream-side housing portion and the angle reference surface is an obtuse angle, the upstream-side housing portion includes an outer peripheral edge (P) having an arc shape on the predetermined surface, and the overflow portion includes an introduction path (18*b*) continuous with the upstream-side housing portion and configured to guide the gas to the upstream-side housing portion. At a predetermined location on the outer peripheral edge, the introduction path is connected to the upstream-side housing portion along a tangential direction (A) of the outer peripheral edge. As a result, the introduction path of the overflow portion is connected to the upstream-side housing portion of the housing section for housing the valve element and to the arc-shaped outer peripheral edge of the upstream-side housing portion, along the tangential direction of the outer peripheral edge. Therefore, the gas flowing from the introduction path into the upstream-side housing portion forms a swirling flow that swirls along the outer peripheral edge. As a result, it is possible to prevent foreign matter in the gas from colliding with the shut-off valve 20 or the like and adhering or sticking to the shut-off valve 20 or the like. Further, the angle formed by the axis of the downstream-side housing portion and the predetermined surface (angle reference surface) where the overflow portion is formed is set to be an obtuse angle, whereby generation of turbulent flow caused by rapid change of the direction in which the gas flows can be suppressed, and adhesion and sticking of the foreign matter to the shut-off valve or the like can be further suppressed.

[2] A width (W1) of the introduction path is smaller than a diameter (R) of the outer peripheral edge, and the introduction path is connected to the outer peripheral edge in a manner that a central axis (C1) of the introduction path is shifted from a center of the outer peripheral edge. As a result, the swirling force of the gas flowing from the introduction path into the upstream-side housing portion is increased, whereby it is possible to more strongly prevent the foreign matter in the gas from adhering or sticking to the shut-off valve or the like.

[3] The predetermined surface is along a vertical line (Lp), and a central axis of the introduction path is along the predetermined surface and forms a predetermined angle (θ3) with respect to the vertical line. Thus, it is possible to set the swirling force and the swirling direction of the swirling flow.

[4] The introduction path includes a bottom surface (18*b*1) having a planar shape and extending along a central axis of the introduction path, and a width of the bottom surface becomes smaller toward the predetermined location. This makes it possible to increase the velocity of the gas flowing from the introduction path into the upstream-side housing portion and thus the swirling force, thereby preventing the stagnation of the gas in the vicinity of the valve element, and thus more strongly preventing the foreign matter in the gas from adhering to the shut-off valve or the like and being caught therein.

[5] At least when the shut-off valve is in an open state, a cross-sectional area of a gap (Gb) between the downstream-side housing portion and the downstream-side valve portion on a plane perpendicular to the axis (C0) of the downstream-side housing portion increases from the abutment portion toward the downstream side within a certain distance from the abutment portion. As a result, it is possible to prevent turbulent flow from occurring in the downstream-side housing portion and to prevent the foreign matter in the gas from adhering or sticking to the shut-off valve or the like.

[6] The downstream-side valve portion has a truncated cone shape whose diameter decreases from the abutment portion toward the downstream side. As a result, within a certain distance from the abutment portion, the cross-sectional area of the gap between the downstream-side housing portion and the downstream-side valve portion can be increased with distance from the abutment portion.

[7] The gas flowing from the introduction path into the downstream-side housing portion forms a swirling flow that swirls along the outer peripheral edge, and the downstream-side valve portion includes a rib (40*d*) extending along a swirling direction of the swirling flow. By adding the rib, the swirling flow of the gas can be further maintained and enhanced.

What is claimed is:

1. A gas suction device of a casting mold, comprising:

an overflow portion connected to a cavity portion of the casting mold and formed along a predetermined surface;

a suction path configured to suck gas in the cavity portion via the overflow portion; and a shut-off valve connected between the overflow portion and the suction path and configured to allow the suction path to be blocked, wherein the shut-off valve includes a valve element and a housing section configured to house the valve element, the housing section includes a valve seat portion, an upstream-side housing portion located on an upstream side of the valve seat portion, and a downstream-side housing portion located on a downstream side of the valve seat portion, the valve element includes an abutment portion configured to abut against the valve seat portion to block the suction path, an upstream-side valve portion located on an upstream side of the abutment portion, and a downstream-side valve portion located on a downstream side of the abutment portion, the predetermined surface includes an angle reference surface between the overflow portion and a position where an axis of the valve element intersects the predetermined surface, an angle formed by an axis of the downstream-side housing portion and the angle reference surface is an obtuse angle, the upstream-side housing portion includes an outer peripheral edge having an arc shape on the predetermined surface, the overflow portion includes an introduction path continuous with the upstream-side housing portion and configured to guide the gas to the upstream-side housing portion, and at a predetermined location on the outer peripheral edge, the introduction path is connected to the upstream-side housing portion along a tangential direction of the outer peripheral edge.

2. The gas suction device of the casting mold according to claim 1, wherein a width of the introduction path is smaller than a diameter of the outer peripheral edge, and the introduction path is connected to the outer peripheral edge in a manner that a central axis of the introduction path is shifted from a center of the outer peripheral edge.

3. The gas suction device of the casting mold according to claim 1, wherein the predetermined surface is along a vertical line, and a central axis of the introduction path is along the predetermined surface and forms a predetermined angle with respect to the vertical line.

4. The gas suction device of the casting mold according to claim 1, wherein the introduction path includes a bottom surface having a planar shape and extending along a central axis of the introduction path, and a width of the bottom surface becomes smaller toward the predetermined location.

5. The gas suction device of the casting mold according to claim 1, wherein at least when the shut-off valve is in an open state, a cross-sectional area of a gap between the downstream-side housing portion and the downstream-side valve portion on a plane perpendicular to the axis of the downstream-side housing portion increases from the abutment portion toward the downstream side within a certain distance from the abutment portion.

6. The gas suction device of the casting mold according to claim 5, wherein the downstream-side valve portion has a truncated cone shape whose diameter decreases from the abutment portion toward the downstream side.

7. The gas suction device of the casting mold according to claim 1, wherein the gas flowing from the introduction path into the downstream-side housing portion forms a swirling flow that swirls along the outer peripheral edge, and the downstream-side valve portion includes a rib extending so as to follow a swirling direction of the swirling flow.

* * * * *